US010876729B2

(12) United States Patent
Hodges

(10) Patent No.: US 10,876,729 B2
(45) Date of Patent: Dec. 29, 2020

(54) APPARATUS FOR REGULATING THE SIZE AND INTENSITY OF TORCH FLAME

(71) Applicant: Gabriel James Hodges, Eugene, OR (US)

(72) Inventor: Gabriel James Hodges, Eugene, OR (US)

(73) Assignee: Gabirel James Hodges, Eugene, OR (US)

( * ) Notice: Subject to any disclaimer, the term of this patent is extended or adjusted under 35 U.S.C. 154(b) by 160 days.

(21) Appl. No.: 16/145,171

(22) Filed: Sep. 28, 2018

(65) Prior Publication Data

US 2019/0093887 A1 Mar. 28, 2019

Related U.S. Application Data

(60) Provisional application No. 62/564,801, filed on Sep. 28, 2017.

(51) Int. Cl.
*F23N 1/02* (2006.01)
*F23N 5/24* (2006.01)
*F23D 14/46* (2006.01)

(52) U.S. Cl.
CPC ..... *F23N 1/027* (2013.01); *F23D 14/465* (2013.01); *F23N 5/24* (2013.01); *F23N 2235/24* (2020.01)

(58) Field of Classification Search
CPC ..... F16K 31/62; B05B 7/1209
USPC ..... 431/2, 8, 12, 18; 251/295; 137/637, 137/637.1, 594, 595
See application file for complete search history.

(56) References Cited

U.S. PATENT DOCUMENTS 749,136 A * 1/1904 Lewis et al. ..... F15B 13/0417 137/596
1,094,761 A * 4/1914 Thousand ..... A62C 35/20 137/355.18
1,318,813 A * 10/1919 Smith ..... B05B 7/12 239/413
1,413,755 A * 4/1922 Messman ..... B67D 1/0083 137/241
1,457,520 A * 6/1923 Garden ..... F23K 5/16 137/594
2,012,107 A * 8/1935 Papadopoulos ..... B67D 1/105 137/607
2,188,258 A * 1/1940 Zinkil ..... F16K 31/62 137/630.17
2,287,011 A * 6/1942 Beebe ..... F16K 31/62 74/512
2,529,852 A * 11/1950 Snowden ..... A62C 99/0027 137/637
3,353,554 A * 11/1967 Ludkin ..... F16K 11/166 137/595

(Continued)

*Primary Examiner* — Justin M Jonaitis

(57) ABSTRACT

An apparatus that regulates the size and intensity of a torch flame by controlling the release of oxygen and a fuel, such as propane. The apparatus releases oxygen and fuel by pivoting a flame control plate that opens and closes mini ball valves using a mini ball connecting bracket. The further forward the plate is pivoted, the more open the valves become increasing the size and intensity of the torch flame. Slotted holes at different angles on the mini ball valve connecting bracket cause the apparatus to release oxygen first resulting in a quiet flame ignition and to release oxygen last to blow out the last flow of fuel, resulting in a safe operation.

1 Claim, 2 Drawing Sheets

(56) References Cited

U.S. PATENT DOCUMENTS

2014/0205957 A1* 7/2014 Logan ..... B23K 37/006
431/18

* cited by examiner

APPARATUS FOR REGULATING THE SIZE AND INTENSITY OF TORCH FLAME

FIELD

The present application relates to an apparatus (the pedal) that quietly and safely regulates the size and intensity of a torch flame for open flame torches, in particular without the use of hands.

BACKGROUND

Foot pedals are often used by torch users to turn on and off the propane and oxygen feeds that fuel a torch. These pedals use electric solenoid valves or pin valves that do not control either the size or the intensity of the flame. This requires the operator to manually adjust the flame while holding their work. This is cumbersome and inefficient and does not allow for the operator to handle and shape the work with both hands. In addition, people without the use of their legs or one hand are physically unable to do open flame torch work with these pedals. These other pedals also make a "pop" sound when the flame is ignited and extinguished.

SUMMARY

By providing the pedal that embodies a valve-connecting bracket with timing angles in the holes and connecting that bracket to mini ball valves rated for propane and one mini ball valve rated for oxygen, one flame control plate can move both the propane valve and the oxygen valve open and closed at the same time. This construction allows the user to regulate, hands-free, the size and intensity of the torch flame by increasing and decreasing pressure on the flame control plate.

The disclosed exemplary embodiment provides en apparatus that operates with this slight timing difference on the bracket using mini ball valves, allowing the pedal user to safely and quietly control the flow of fuel and oxygen to the torch without the use of hands.

By angling the bracket to open the oxygen valve first and the propane valve second, the pedal starts quietly because the oxygen reduces the intensity of the propane-fueled flame.

By angling the bracket to close the propane valve first and the oxygen valve second, safe operation is ensured because the oxygen extinguishes the last flame.

Further objects, features, advantages and properties of the pedal according to the present application will become apparent from the detailed description.

BRIEF DESCRIPTION OF THE DRAWINGS

In the following detailed portion of the present description, the construction and function of the pedal are demonstrated in the following embodiment and illustrated in the drawings, in which.

DETAILED DESCRIPTION

In the following detailed description, the pedal according to the teachings for this application will be described by the embodiment. All parts noted in this description are stainless steel unless otherwise noted. Where another material is used instead of steel or brass, the embodiment includes the use of that material. For example, if brass mini ball valves are replaced by steel mini ball valves, the embodiment includes the use of this alternative material. All of the nuts are course-threaded, but fine thread could also be used and the embodiment includes the use of this alternative thread. All parts are assembled with propane-rated thread sealer tape but other fuel-grade thread sealant products could be used.

An embodiment of the pedal is illustrated in FIGS. 1, 2, 3, and 4 combined.

Figure 1:
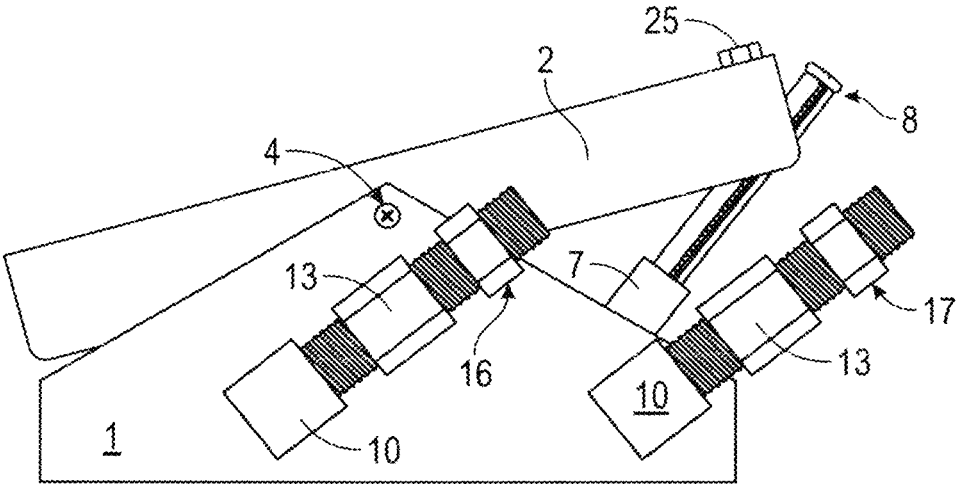
FIG. 1 is a side view of the assembled apparatus (pedal)

FIG. 1 shows a side view of the whole assembled pedal from front to back (left to right) as it sits on a level surface in the partially "on" position. The oxygen and propane feeds to the torch have dedicated connectors located on opposite sides of the pedal. FIG. 1 shows the side of the pedal where the oxygen connectors (16 and 17) are located.

FIG. 1 demonstrates the interaction between the flame control plate (2), the control shaft (8) and the ball valve timed connecting bracket (7) as it pertains to the oxygen side of the pedal.

As shown in FIG. 1, the pedal comprises a main housing (1). Attached to the main housing (1) are: a flame control plate (2); two weld hose oxygen connectors (16 and 17); and a ball valve timed connecting bracket (7). The flame control plate (2) is attached to the main housing (1) through a pivot shaft (4) inserted through holes in the peak of the main housing (1). The two weld hose connectors (16 and 17) are attached to the main housing (1) by ¼ inch 90 degree street elbows (10) and ¼ inch NPT female couplers (13). The control shaft (8) is attached to the flame control plate (2) by a control shaft connector (3) which is illustrated in FIG. 3, The control shaft connector (3) is attached to the flame control plate (2) by a #8 nut (25). The control shaft (8) is attached to the ball valve connecting bracket (7), as illustrated in FIG. 2.

In this embodiment of the pedal shown in FIG. 1, a hose from an oxygen tank (not shown) is connected to a weld hose connector 122RWA (16) and a hose from a torch's oxygen inlet connection (not shown) is connected to a weld hose connector 122RWA (17). The pedal is operated by applying pressure to the tip of the flame control plate (2) where the control shaft connector (3) is located, causing the control shaft to slide and depress the ball valve timed connecting bracket (7), releasing oxygen to the torch. As it is illustrated in FIG. 1, the flame control plate (2) is partially depressed which will release oxygen from the weld hose connector 122RWA (16) into weld hose connector 122RWA (17).

Figure 2:
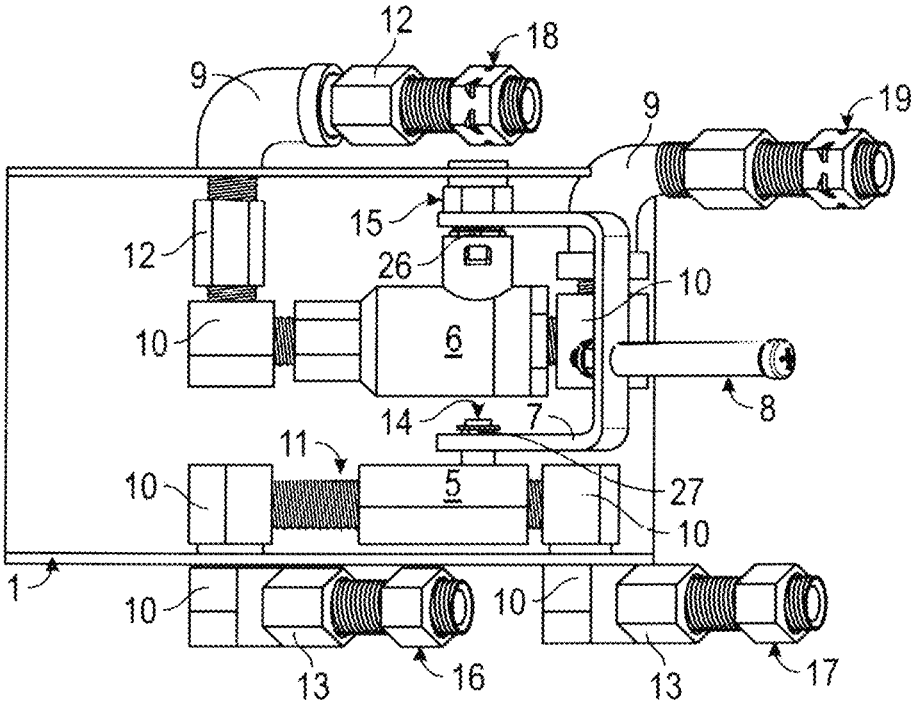
FIG. 2 is a plan view of the pedal minus the parts shown in FIG. 3.
Figure 3:
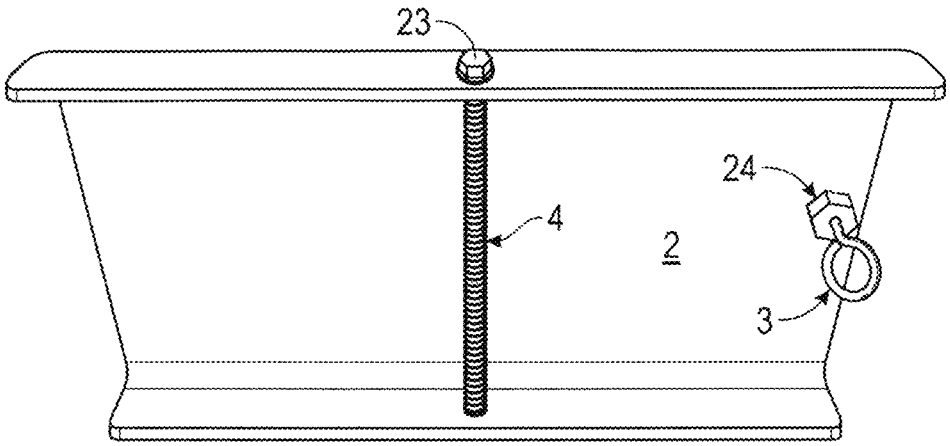
FIG. 3 is an isometric view of parts not shown in FIG. 2.

FIG. 2 is a plan view of the pedal without the flame control plate (2). FIG. 2 shows the propane side of the pedal and the parts of the pedal within the main housing for both sides of the pedal.

FIG. 1 illustrates the oxygen side of the pedal outside the main housing (1), FIG. 2 illustrates the oxygen side of the pedal inside the main housing (1). As shown in FIG. 2, the oxygen flows from the weld hose connector 122RWA (16) through a ¼ inch NPT female coupler (13), then two ¼ inch 90 degree street elbows (10), then a ¼ inch NPT nipple (11) to a ¼ inch brass mini ball valve (5). The ball valve timed connecting bracket (7) is attached to the ¼ inch brass mini ball valve (5) by a ball valve connecting bracket screw (14). When the ball valve timed connecting bracket (7) is depressed, the ¼ inch brass mini ball (5) opens and oxygen flows to the torch through two ¼ inch 90 degree street elbows (10) and a ¼ inch NPT female coupler (13).

As shown in FIG. 2, the propane connectors (18 and 19) are located on the opposite side of the pedal from the oxygen connectors (16 and 17). FIG. 2 illustrates the propane side of the pedal both outside and inside the main housing (1). In this embodiment of the pedal shown in FIG. 2, a hose from a propane tank (not shown) is connected to a weld hose connector 122LWA (18) and a hose from a torch's propane inlet connection (not shown) is connected to a weld hose connector 122LWA (19). As shown in FIG. 2, the propane flows from the weld hose connector 122LWA (18) through a ¼ inch NPT male to ¼ inch NPT female connector (12), then through a ¼ inch stainless steel 90 degree street elbow (9), then through another ¼ inch NPT male to ¼ inch NPT female connector (12), then through a ¼ inch 90 degree street elbow (10) and into a propane rated ¼ inch brass mini ball valve (6). The ball valve timed connecting bracket (7) is attached to the propane rated ¼ inch brass mini ball valve (6) by a ¼ inch propane mini ball valve connecting bracket nut (15).

When the ball valve timed connecting bracket (7) is depressed, the propane rated ¼ inch brass mini ball valve (6) opens and propane flows through a ¼ inch 90 degree street elbow (10), then through a ¼ inch stainless steel 90 degree street elbow (9), and then through the weld hose connector 122LWA (19) to the torch.

The ball valve timed connecting bracket (7) is designed so that the oxygen intake occurs first (before the propane intake) when the torch flame is ignited and the oxygen is released last (after the propane release) when the torch flame is extinguished. This occurs because the slotted holes (26, 27) on each side of the ball valve timed connecting bracket (7) that allow the connections to the ¼ inch brass mini ball valves (5 and 6) are angled differently. On the oxygen side of the pedal, the ball valve connecting bracket screw (14) passes through one of these slotted holes (27) angled at 25 degrees; on the propane side of the pedal, the propane ¼ inch mini ball valve connecting bracket screw (15) passes through a slotted hole (26) angled at 23 degrees.

FIG. 3 illustrates the underside of the flame control plate (2) in an isometric view. The pivot shaft (4) is shown that connects the flame control plate (2) to the main housing (1). The pivot shaft (4) is a 3¼ inch #8 stainless steel bolt that connects the flame control plate (2) to the main housing (1) by a #8 stainless steel lock nut (23) screwed on to the bolt on the outside of the flame control plate (2).

FIG. 3 also illustrates the control shaft connector (3) as it appears under the flame control plate (2). The control shaft connector (3) is an eye bolt attached to the flame control plate with two #8 nuts. The #8 nut (24) on the underside of the flame control plate (2) is shown here and the one on the top of the flame control plate is shown in FIG. 1. The control shaft (8) slides through this eye bolt when pressure is applied to and released from the flame control plate (2).

Figure 4:
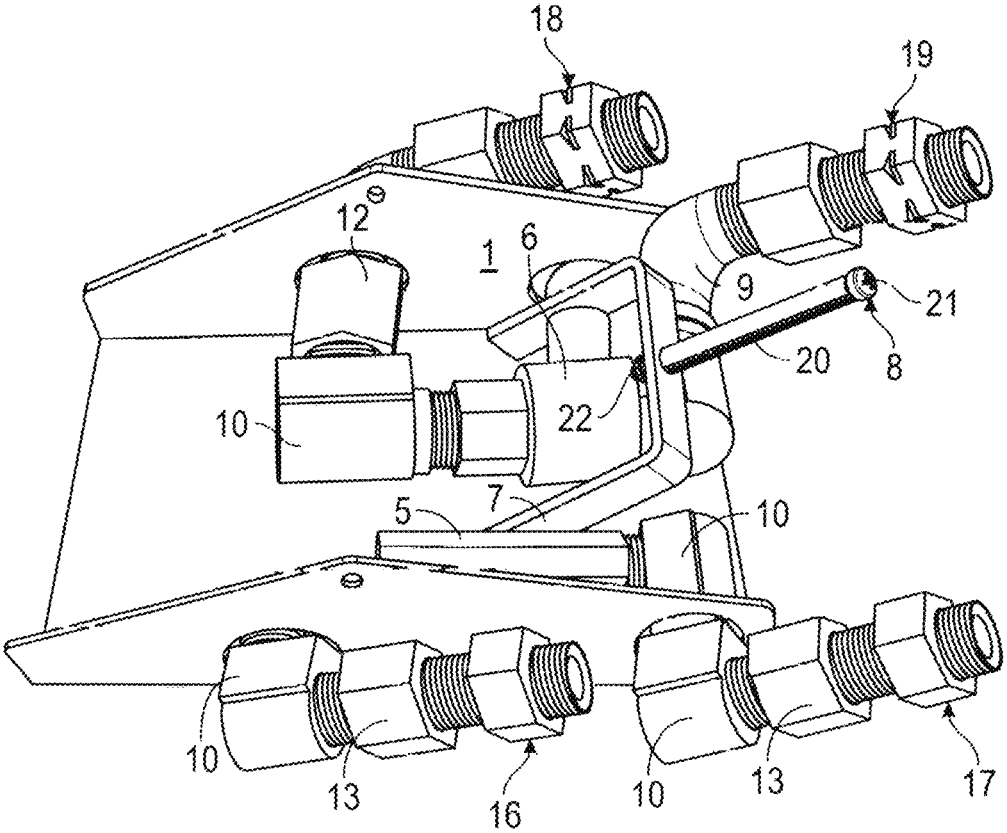
FIG. 4 is an isometric view of the inside of the pedal.

FIG. 4 is an isometric view of the pedal that illustrates how the pedal appears in the main housing (1) below the flame control plate (2) which is not shown in FIG. 4. In FIG. 4, the main housing (1) is illustrated in an isometric view. The parts shown are those shown in other figures except for the parts comprising the control shaft (8) and the parts connecting the control shaft (8) to the ball valve timed connecting bracket (7). In FIG. 4, the control shaft (8) is comprised of a 2 inch steel sleeve (20) which is connected to the ball valve timed connecting bracket (7) by a 2¼ inch stainless steel bolt (21) that is secured by a #8 stainless steel lock nut (22) boated on the underside of the ball valve timed connecting bracket (7).

As demonstrated in FIGS. 1, 2, 3, and 4, the pedal is operated by applying pressure to the tip of the flame control plate (2) where the control shaft connector (3) is located, causing the control shaft (8) to slide in the control shaft connector and putting pressure on the ball valve timed connecting bracket (7), This in turn opens the ¼ inch brass mini ball valve (5) on the oxygen side of the pedal and, next, the propane rated ¼ inch brass mini ball valve (6) on the propane side of the pedal. This action causes first oxygen and then propane to be released to the torch. When pressure is released on the flame control plate (2), the reverse takes place with propane intensity lowered first and oxygen second. When all pressure on the flame control plate (2) is released, the flame is extinguished. As stated above, the ball valve timed connecting bracket (7) is angled so that the oxygen intake occurs first when the torch flame is ignited and released last when the torch flame is extinguished.

As pressure is applied to or released from the flame control plate (2), a torch user can easily adjust the size and intensity of the torch flame or turn the flame on or off without the use of hands. The pedal can be positioned so that foot, elbow, or knee can be used to apply pressure to flame control plate (2).

As pressure is applied to the flame control plate (2), the ball valves (5, 6) crack open, and they begin to allow a small amount of oxygen and fuel to escape outlets on the pedal headed to the torch, allowing the torch to start with the small flame as pressure is applied to the control plate opening the vowels allowing more fuel and oxygen to pass through the pedal creating a larger flame. As the valve opens larger, the flame gets larger until the pedal is fully open and the flame is at maximum size. As this point, the torch user can set a large hot flame at the torch knobs and as the user releases and reapplies pressure on the pedal, the flame size and intensity are adjusted corresponding to the pressure applied. This occurs because the control bracket releases a small amount of oxygen shrinking the flame. As the pedal pressure is released, the valve continues to close and the slightly open oxygen valve blows the flame out right before it shuts off.

The teaching of the present application has numerous advantages. Different embodiments or implementations may yield one or more of the following advantages. It should be noted that this is not an exhaustive list and there may be other advantages which are not described herein. For example, one advantage of the teaching of this application is it provides for an apparatus that not only ignites and extinguishes a torch flame but also regulates the size and intensity of the flame. It is yet another advantage of the present invention that the pedal can be operated hands-free, allowing the user to handle the object of the torch work with both hands. It is a further advantage that the bracket is angled to time the opening of the oxygen valve first for a silent start eliminating the "pop" sound heard when other pedals are used. It is yet another advantage that the oxygen closes last, blowing out the last flame from the propane, allowing for safe operation of the pedal.

Although the teaching of the present application has been described in detail for purpose of illustration, it is understood that such detail is solely for that purpose, and variations can be made therein by those skilled in the art without departing from the scope of the teaching of this application. For example, the apparatus has been described as a pedal, but it is understood that it does not have to be operated by foot and can be operated by elbow, knee, or hand, as desired. It should be noted that there are many alternative ways of implementing the methods and apparatuses of the teachings of the present application. Features descried in the preceding description may be used in combinations other than the combinations explicitly described.

Whilst endeavoring in the foregoing specification to draw attention to those features of the invention believed to be of particular importance, it should be understood that the Applicant claims protection in respect of any patentable feature or combination of features hereinbefore referred to and/or shown in the drawings whether or not particular emphasis has been placed thereon.

The term "comprising" as used in the claims does not exclude other elements or steps. The term "a" or "an" as used in the claims does not exclude a plurality. A unit or other means may fulfill the functions of several units or means recited in the claims.

The invention claimed is:

1. A foot pedal apparatus to regulate a size and intensity of a torch flame comprising:

a main housing;

an oxygen inlet and an oxygen outlet located on an exterior of the main housing and a first gas rated mini ball valve located on an interior of the main housing and between the oxygen inlet and the oxygen outlet;

a fuel inlet and a fuel outlet located on the exterior of the main housing on a side opposite of a side the oxygen inlet and the oxygen outlet are located, and a second gas rated mini ball valve located on the interior of the main housing between the fuel inlet and the fuel outlet;

a ball valve timed connecting bracket connected to the first and the second gas rated mini ball valve such that movement of the connecting bracket causes simultaneous movement of the first and second gas rated mini ball valves;

a flame control plate connected to the ball valve timed connecting bracket and connected to the main housing by a pivot shaft such that a foot of a user can swivel the flame control plate about the pivot shaft to control an opening and a closing of the first and second gas rated mini ball valves;

wherein the first gas rated mini ball valve opens before and closes after the second gas rated mini ball valve such that in an opening process a flow of oxygen begins prior to a flow of fuel and during a closing process the flow of oxygen continues after the flow of fuel ends until the first gas rated mini ball valve returns to a closed position.

* * * * *